US005941428A

United States Patent [19]

Behar et al.

[11] Patent Number: 5,941,428

[45] Date of Patent: Aug. 24, 1999

[54] DISPENSING DEVICE FOR FLUID PRODUCTS

[75] Inventors: Alain Behar, Suresnes; Stanislas Peronnet, Le Mans, both of France

[73] Assignee: Teleplastics Industries, Parigne l'Eveque, France

[21] Appl. No.: 09/041,034

[22] Filed: Mar. 12, 1998

[30] Foreign Application Priority Data

Mar. 14, 1997 [FR] France ..... 97 03125

[51] Int. Cl.[6] ..... B67D 5/40

[52] U.S. Cl. ..... 222/321.7; 222/385

[58] Field of Search ..... 222/321.1, 321.2, 222/321.7, 321.9, 380, 385

[56] References Cited

U.S. PATENT DOCUMENTS

| | | | |
|---|---|---|---|
| 4,230,242 | 10/1980 | Meshberg | 222/321.2 |
| 4,773,553 | 9/1988 | Van Brocklin | 215/272 |
| 4,984,702 | 1/1991 | Pierpont | 215/272 |
| 5,562,219 | 10/1996 | De Pous et al. | 222/385 |
| 5,829,645 | 11/1998 | Hennemann | 222/321.9 |

FOREIGN PATENT DOCUMENTS

| | | |
|---|---|---|
| 0 653 359 | 5/1995 | European Pat. Off. . |
| 0 704 251 | 4/1996 | European Pat. Off. . |
| 0 707 895 | 4/1996 | European Pat. Off. . |
| 2 274 836 | 8/1994 | United Kingdom . |
| 2 301 634 | 12/1996 | United Kingdom . |

*Primary Examiner*—Joseph A. Kaufman
*Attorney, Agent, or Firm*—Young & Thompson

[57] ABSTRACT

A dispensing device for fluid products comprises a receptacle having a neck (1) with a cylindrical bore and a lip (4) having a redan (4*b*). A pump body (2) encloses a piston pump mechanism with an axial nozzle. The body of the pump (2) is sealingly mounted on the receptacle by a sleeve (9), a skirt (5) provided on an internal wall with a transverse partition (7) having a central opening (8) adapted to receive the body of the pump (2) and a sealing joint (11) disposed between the body of the pump (2) and the lip (4) of the neck (1) of the receptacle. The skirt (5) is of an elastically deformable material, the skirt (5) having at an upper end thereof a right cylindrical portion (5*a*) whose external diameter is substantially equal to the internal diameter of the sleeve (9), and below the upper portion (5*a*) a truncated conical portion (5*b*) flaring outwardly downwardly and whose height is at least as great as the height of said lip (4) of the neck (1) of the receptacle. The skirt (5), below the truncated conical portion (5*b*), has a straight cylindrical portion (5*c*) whose diameter is substantially equal to the largest external diameter of the truncated conical portion (5*b*). The skirt (5) has on an internal surface thereof, substantially at the level of a junction between the truncated conical portion (5*b*) and the lower straight portion (5*c*), a projection (10) extending radially inwardly of the skirt (5).

9 Claims, 2 Drawing Sheets

DISPENSING DEVICE FOR FLUID PRODUCTS

This application corresponds to French application 97 03125 of Mar. 14, 1997, the disclosure of which is incorporated herein by reference.

The present invention relates to a dispensing device for fluid products, of the type comprising a receptacle having a neck with a cylindrical bore provided with a lip provided with a redan and a pump body enclosing the mechanism of a piston pump that carries an axial nozzle and, more particularly, a dispensing device used in the field of cosmetic and/or pharmaceutical products.

In known dispensing devices, the pump body is generally mounted on the neck of the receptacle by force-fitting, or is clamped onto the neck of the receptacle, or else is mounted by means of a skirt or a collar.

In this last case, the skirt serves not only as the centering means for the pump body, but also for its securement and for the provision of a tight connection between the pump body and the receptacle.

The collars or skirts generally used can be screw collars, clamp collars, snap-on skirts or force-fitted skirts and other types of known collars.

There is thus known, from WO-A-88/02297, a collar having a peripheral skirt extending sealingly along the external wall of the neck of a receptacle on which it is emplaced, said collar resting on the neck of the receptacle and being adapted to receive a pump body. So as to permit the securement of this collar on the neck of the receptacle, the lower edge of the peripheral external skirt is preferably cut out at a plurality of tongues which have at their end a radially outwardly projecting portion. Thus, when the collar is mounted on the neck of a glass receptacle, a peripheral skirt extends along the external wall of the neck, the means at the end of the tongue projecting radially outwardly. The neck of the receptacle, when it is of glass, generally has a flange or lip at its upper edge and the tongues are provided such that the projecting means are located substantially below the flange of the neck of the receptacle when the collar is mounted on said neck. So as to secure the collar on the receptacle, there is emplaced a small gripping collar which slides along the external peripheral skirt of the collar and presses inwardly the projecting means on the tongues, below the flange of the neck of the receptacle in the secured position.

The use of this type of collar is satisfactory for conventional uses but however has a shape and a configuration that are relatively cumbersome and complex.

There is also known comparable securement means of closure devices on glass receptacles. Thus, the document FR-A-2 534 557 discloses a closure device having a cylindrical sealing portion extending inwardly of the neck of a receptacle and an external skirt cut off in segments, each segment comprising a radial internal projection adapted to engage below the flange of the neck of a receptacle under the action of a covering cap emplaced on said device. Thus, the internal projections are maintained in engagement below the flange when the covering cap is emplaced.

In comparison to the device described in WO-A-88/02297, such a device has a less complicated configuration of the external peripheral skirt; in particular, it is not necessary to provide external deformable projections whose deformable portion engages below the flange. Similarly, the emplacement of the covering cap does not require exerting high force as there are no projecting elements in the pathway of the covering cap.

There is also known, from U.S. Pat. No. 4,251,003, a closure device for a receptacle comprising a cap provided with a peripheral skirt extending outside the neck of the receptacle and constituted by four distinct segments, said segments having a truncated conical shape flared outwardly and comprising projecting elements at their end on their internal surface. These truncated conical shaped segments form a projection in the path of a covering cap such that said segments are pressed toward the neck of the receptacle and the projecting elements are disposed below the flange of the neck of the receptacle upon emplacement of the covering cap.

In the case of the emplacement of a pump on the neck of the receptacle provided with a lip having a redan, and more particularly glass receptacles, there should be effected a sure and sealed mounting of said pump. In particular, it is important to be able to absorb with certainty the dimensional variations which can occur in the lip of the neck of receptacles, particularly glass ones, for which the accommodation of tolerances is important and which can compromise sealing.

To this end, the present invention therefore provides a dispensing device for cosmetic or pharmaceutical products permitting obtaining a sealed mounting of the pump on the receptacle, said device being economical and simple to make.

Thus, the invention has for its object a dispensing device for fluid products of the type constituted by a receptacle having a neck with a cylindrical bore provided with a lip having a redan and by a pump body enclosing the mechanism of a piston pump having an axial nozzle, as well as sealed mounting means of the body of the pump as well as means for the sealed mounting of the body of the pump on the receptacle, said means comprising a sleeve, a skirt provided on its internal wall with a transverse partition provided with a central opening adapted to receive the body of the pump and a sealing joint interposed between the body of the pump and the lip of the neck of the receptacle, characterized in that said skirt is constituted by an elastically deformable material, the continuous cylindrical wall of said skirt having, at its upper end, a portion forming a right cylinder whose external diameter corresponds substantially to the internal diameter of the sleeve, in its central region, a truncated conical portion flaring outwardly from the upper straight portion and whose height corresponds substantially to the height of the cylindrical portion of the lip of the neck of the receptacle, and at its lower end, a portion forming a right cylinder whose external diameter corresponds to the external diameter of the larger end of the truncated conical portion, the skirt moreover having on the internal surface of its wall, substantially at the level of the junction between the central portion and the lower portion, a radially inward projection of the skirt.

Thus, in an advantageous way, the lower straight portion of the skirt in substantially at a level located below the redan of the lip such that the radial projection provided on the internal surface of the wall of the skirt is located at the junction between the truncated conical portion and the straight lower portion is positioned substantially below the redan of the lip and lodges in this redan when the central truncated conical portion is forced, particularly by the emplacement of the sleeve over the skirt, to extend along the cylindrical portion of the lip.

In the course of mounting the pump on the glass receptacle, there is emplaced the pump body by engaging the latter into the neck of the receptacle, said pump body having a peripheral small collar that projects and which comes to bear on the upper edge of the lip on which has first been placed the sealing joint.

The skirt is then engaged over the pump body whose upper portion passes through the opening provided in the transverse internal partition of the skirt.

When the sleeve is engaged on the skirt, said sleeve slides freely along the upper straight portion of the skirt and then comes into abutment against the truncated conical portion of the skirt which projects into the path of the sleeve.

So as to continue the engagement of the sleeve on this truncated portion of the skirt and to overcome the resistance offered by said truncated portion of the skirt, a downward force is exerted. The resistance of the truncated conical portion is overcome, and the sealing joint between the pump body and the neck of the receptacle is compressed. The sealing joint has a good flow quality and is made for example of an elastomer.

Preferably, the lip seal projecting on the upper edge of said lip then disappears into the sealing joint, which gives rise to very good sealing.

Continuing the forcing of the sleeve along the skirt forces the truncated conical portion of the wall of the skirt to take a cylindrical shape and to extend along the cylindrical portion of the lip, the radially internal projection of the skirt coming to engage below the redan of the lip. The sleeve continues to slide along the lower right cylindrical portion of the skirt until it comes into abutment against the shoulder of the receptacle.

Thus, in the dispensing device according to the invention, the skirt is maintained against the neck of the receptacle by the action of the sleeve and of its internal radial projection snapped below the redan of the lip.

Moreover, the skirt used in the device according to the invention permits obtaining a perfect seal of the mounting to the extent that it promotes compression of the sealing joint between the pump body and the neck of the receptacle during mounting. Moreover, even if the sealing joint tends to recover its initial thickness, once the downward force is relieved, the abutment of the radial internal projection of the skirt below the redan of the lip tends to maintain a compression of the skirt on the body of the pump and hence on said sealing joint.

Preferably, the resulting compression of the sealing joint is maintained at at least 3% of its value.

Thus, the sealing of the mounting of the pump cannot be affected by the dimensional variations of the lip of the neck of the receptacle as can happen when the sealing is ensured by simple contact of the wall of the skirt with the neck of the receptacle, the sealing joint thus playing a role of compensation to absorb variations.

Thus, preferably, the dispensing device according to the invention is usable on any type of receptacle provided with a lip having a redan, in particular those made of glass for which the accommodation of variations is important.

As a result, the variations which conventionally take place in the course of production, in the dimension of the external diameter of the neck of glass receptacles, can be absorbed by the mounting means of the dispensing device according to the invention without disturbing the seal of said mounting on the receptacle.

Preferably, the sealing joint is constituted of an elastically deformable material having a high flow property, such as an elastomer.

There will now be described in greater detail an example of embodiment of the invention with reference to the accompanying drawing, in which.

Figure 1:
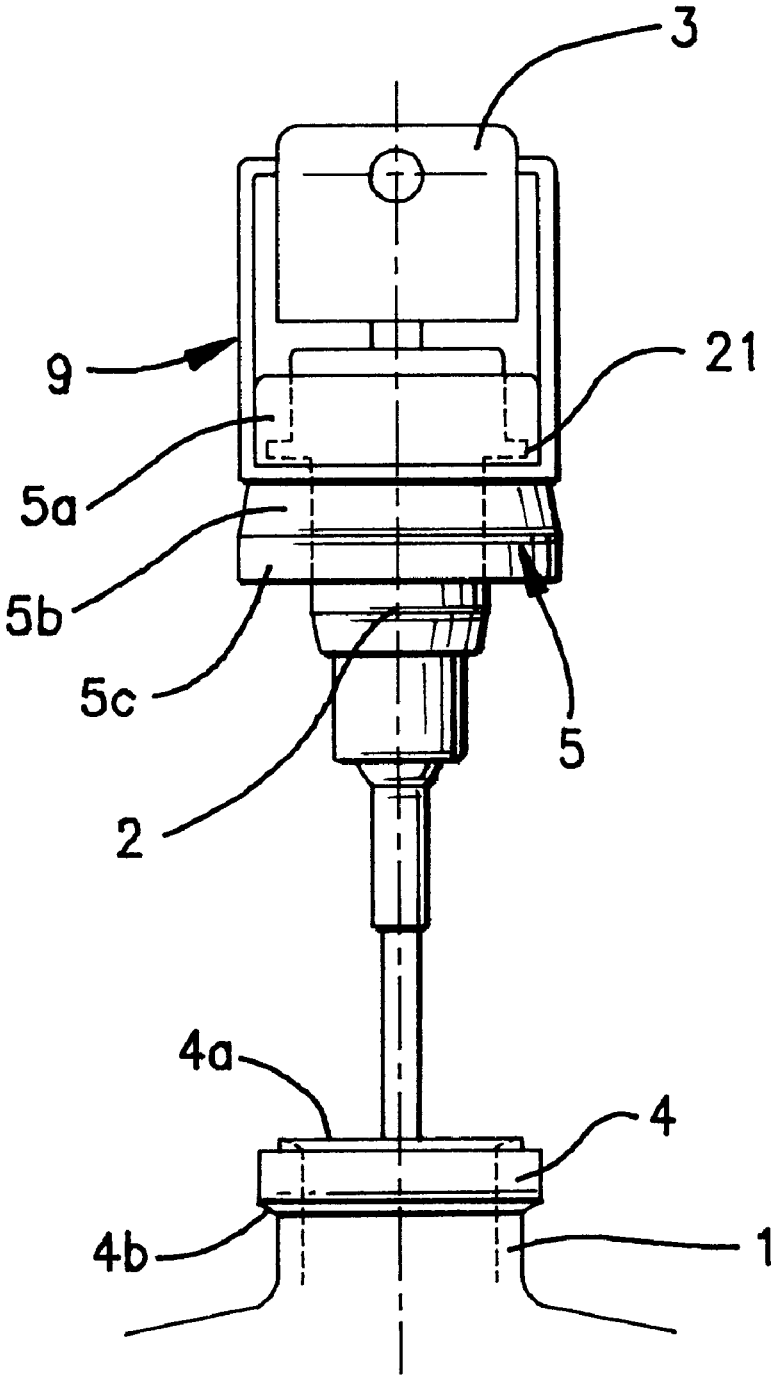
FIG. 1 is a front elevational view of a dispensing device according to the invention before mounting of the pump on the receptacle.

A dispensing device according to the invention comprises a glass receptacle having a neck 1 with a cylindrical bore as well as a mechanical pump enclosed in a pump body 2 and provided at the end of its rod with a push button 3 to actuate said pump.

As is conventional, the upper edge of the neck 1 of the glass receptacle has a flange or lip 4 provided with a lip seal 4*a* and a lower edge or redan 4*b*.

So as to secure the body of pump 2 in engagement in the neck 1 of the receptacle, the device comprises a skirt 5 comprising a continuous cylindrical wall and a transverse internal partition 7 provided with a passage opening 8 adapted to receive the body of pump 2. The skirt 5 is constituted of an elastically deformable material having high flow capacity, such as a low density polyethylene or a thermoplastic elastomer.

The wall of skirt 5 has an upper portion 5*a* which is a right cylinder whose external diameter corresponds to the internal diameter of a sleeve 9 such that this straight upper portion 5*a* permits the prepositioning of the sleeve 9.

The sleeve 9 is of the type of those conventionally used on pumps to be set and can for example be of aluminum.

The wall of the skirt 5 then has a central portion of truncated conical form 5*b* flaring outwardly from the upper portion 5*a*, the wall of the skirt 5 terminating at its lower end again in a right cylindrical portion 5*c*.

The junction between the upper straight portion 5*a* and the truncated conical portion 5*b* of the wall of skirt 5 forms a slight circular projection which constitutes an abutment in the path of the sleeve 9 along the skirt 5.

The height of the truncated conical portion 5*b* corresponds to the height of the external cylindrical portion of the lip 4 such that this truncated portion 5*b* can extend along the lip 4.

There is provided on the internal surface of the skirt 5, substantially at the junction between the truncated conical portion 5*b* and the lower straight portion 5*c*, a radially inward projection 10 of the skirt 5, which can be continuous or discontinuous. The junction between the truncated portion 5*b* and the lower straight portion 5*c* of the skirt 5 being located substantially at a level below the redan 4*b* of the lip 4, the projection 10 is also located substantially below the redan 4*b* of the lip 4.

During mounting, there is emplaced on the upper edge of the lip 4, a sealing joint 11 resting against the lip seal 4*a* such that said body 2 has an annular projecting collar 21, that comes to bear on the sealing joint 11.

Preferably, the body of pump 2 can already have the sealing joint 11 which is then secured to the angular collar 21.

There is then installed on the body of pump 2, the skirt 5 with the sleeve 9 prepositioned along the straight upper portion 5*a* of the skirt 5.

The upper end of the body of pump 2 has, above the collar 21, a continuous peripheral groove 22 in which can be disposed the edge of the passage opening 8 provided in the transverse partition 7.

So as to drive slidingly the sleeve 9 along the skirt 5 and more particularly along the truncated conical portion 5*b*, there is exerted a downward force so as to overcome the resistance opposed by said truncated portion 5*b* projecting in the path of the sleeve 9.

Exerting this force results in compression of the sealing joint 11 which flows and into which disappears totally the lip seal 4*a*, thereby ensuring a seal.

Figure 3:
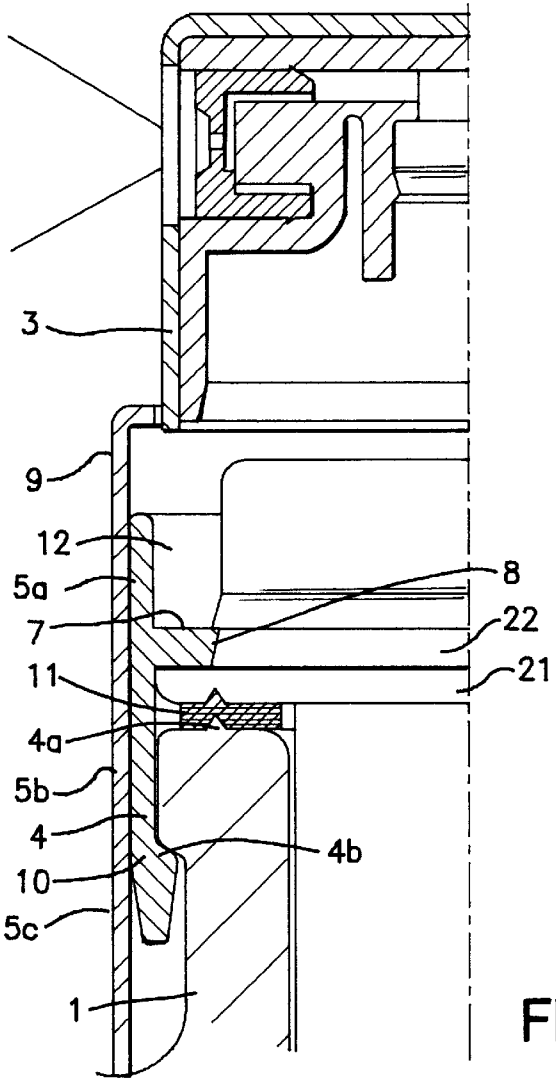
FIG. 3 is a cross-sectional view of the dispensing device according to FIG. 2, after mounting.
Figure 2:
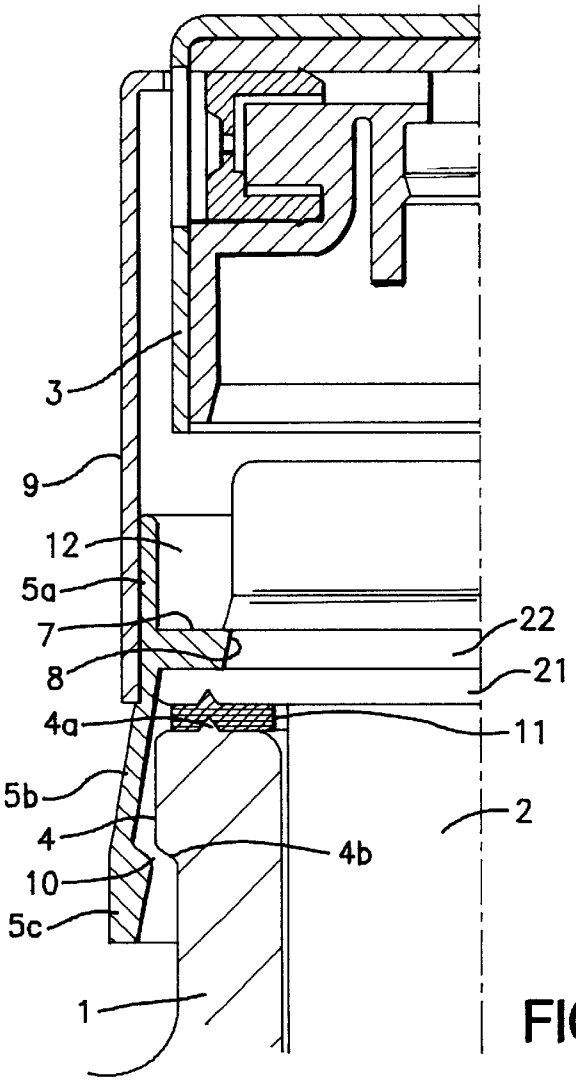
FIG. 2 is a cross-sectional view of the dispensing device of FIG. 1.

Once the resistance of the truncated conical portion 5*b* is overcome, the sleeve 9 imposes on the latter a right cylindrical shape extending opposite the cylindrical portion of lip 4 (see FIG. 3). Then, at the junction between the truncated conical portion 5*b* and the lower straight portion 5*c*, the sliding of the sleeve 9 engages the radial projection 10 below the redan 4*b* of the lip 4.

There is thus obtained a sure and perfectly sealed mounting of the pump on the receptacle of the dispensing device according to the invention.

So as to permit emplacement of a push button 3 on the pump rod and the actuation of said pump, the internal diameter of the skirt 5 is such as to permit the creation of a space 12 between the upper straight portion 5*a* of the skirt 5 and the body of pump 2 in which the push button 3 can engage during depression of said push button for actuating the pump.

The dispensing device can be sold with the skirt and the pump preassembled, to which are added the sleeve and the pump push button. The assembly of the pump, skirt, sleeve and push button could also be preassembled.

What is claimed is:

1. In a dispensing device for fluid products, comprising a receptacle having a neck (1) with a cylindrical bore and a lip (4) having a redan (4*b*), a pump body (2) enclosing a piston pump mechanism with an axial nozzle, and means for sealingly mounting the body of the pump (2) on the receptacle, said means comprising a sleeve (9), a skirt (5) provided on an internal wall with a transverse partition (7) having a central opening (8) adapted to receive the body of the pump (2) and a sealing joint (11) disposed between the body of the pump (2) and the lip (4) of the neck (1) of the receptacle; the improvement wherein said skirt (5) is of an elastically deformable material, the skirt (5) having at an upper end thereof a right cylindrical portion (5*a*) whose external diameter is substantially equal to the internal diameter of the sleeve (9), and below the upper portion (5*a*) a truncated conical portion (5*b*) flaring outwardly downwardly and whose height is at least as great as the height of said lip (4) of the neck (1) of the receptacle, the skirt (5) having on a lower internal surface thereof a projection (10) extending radially inwardly of said skirt (5).

2. Dispensing device according to claim 1, wherein the skirt (5) is of a low density polyethylene.

3. Dispensing device according to claim 1, wherein the skirt (5) is of a thermoplastic elastomer.

4. Dispensing device according to claim 1, said skirt (5), below said truncated conical portion (5*b*) having a straight cylindrical portion (5*c*) whose diameter is substantially equal to the largest external diameter of said truncated conical portion (5*b*), said projection being located substantially at the level of a junction between said truncated conical portion (5*b*) and said lower straight portion (5*c*).

5. Dispensing device according to claim 4, wherein said lower straight portion (5*c*) of the skirt (5) begins at about the level of said redan (4*b*) of the lip (4).

6. Dispensing device according to claim 5, wherein said radial projection (10) is disposed below the redan (4*b*) of the lip (4) when the sleeve (9) covers said lower straight portion (4*c*).

7. Dispensing device according to claim 1, wherein said sealing joint (11) is of an elastically deformable material.

8. Dispensing device according to claim 7, wherein said sealing joint (11) is secured to an annular collar (21) on the body of the pump (2).

9. Dispensing device according to claim 1, wherein the internal diameter of the skirt (5) provides a space (12) between the straight upper portion (5*a*) of the skirt (5) and the body of the pump (2), and a push button (3) in said space (12) which upon depression actuates the pump (2).

* * * * *